US008388377B2

(12) United States Patent
Zraik

(10) Patent No.: US 8,388,377 B2
(45) Date of Patent: Mar. 5, 2013

(54) SLIDE ACTUATED COAXIAL CABLE CONNECTOR

(75) Inventor: Souheil Zraik, Liverpool, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 13/078,873

(22) Filed: Apr. 1, 2011

(65) Prior Publication Data

US 2012/0252268 A1 Oct. 4, 2012

(51) Int. Cl.
*H01R 9/05* (2006.01)

(52) U.S. Cl. ..... 439/584; 439/578

(58) Field of Classification Search ..... 439/584, 439/578–581, 63

See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 2,102,495 | A | 12/1937 | England |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |

(Continued)

FOREIGN PATENT DOCUMENTS

| | | | |
|---|---|---|---|
| CA | 2096710 | A1 | 11/1994 |
| CN | 201149936 | Y | 11/2008 |

(Continued)

OTHER PUBLICATIONS

Digicon AVL Connector. ARRIS Group Inc. [online]. 3 pages. [retrieved on Apr. 22, 2010]. Retrieved from the Internet:<URL: http://www.arrisi.com/special/digiconAVL.asp>.

*Primary Examiner* — Javaid Nasri

(74) *Attorney, Agent, or Firm* — Schmeiser, Olsen & Watts, LLP

(57) ABSTRACT

There is provided a coaxial cable connector for coupling an end of a coaxial cable to an outer diameter of a threaded interface port. The coaxial cable connector includes a connector body, a tubular inner post, and a sleeve member. The connector body has a first end, an opposing second end, and a bore therethrough. The inner post is disposed within the bore of the connector body, and includes a first end and a second end. The first end is adapted to engage the connector body so as to prevent relative axial movement with the connector body. The second end of the inner post is adapted to be inserted into the end of the coaxial cable. Either the first end of the connector body or the first end of the inner post includes a basket portion adapted to engage the threaded interface port. The basket portion includes an outer diameter, an inner diameter that is less than the outer diameter of the threaded interface port, and a relief element. The relief element is adapted to radially expand the outer diameter of the basket portion upon engaging the interface port. The sleeve member is disposed in overlaying relation to the basket portion, and includes an inner diameter that is less than the expanded outer diameter of the basket portion. The sleeve member is axially movable in relation to the basket portion from a first position to a second position to radially compress the basket portion.

18 Claims, 18 Drawing Sheets

U.S. PATENT DOCUMENTS

| | | | | |
|---|---|---|---|---|
| 2,694,187 | A | | 11/1954 | Nash |
| 2,754,487 | A | | 7/1956 | Carr et al. |
| 2,755,331 | A | | 7/1956 | Melcher |
| 2,757,351 | A | | 7/1956 | Klostermann |
| 2,762,025 | A | | 9/1956 | Melcher |
| 2,805,399 | A | | 9/1957 | Leeper |
| 2,870,420 | A | | 1/1959 | Malek |
| 3,001,169 | A | | 9/1961 | Blonder |
| 3,015,794 | A | | 1/1962 | Kishbaugh |
| 3,091,748 | A | | 5/1963 | Takes et al. |
| 3,094,364 | A | | 6/1963 | Lingg |
| 3,184,706 | A | | 5/1965 | Atkins |
| 3,194,292 | A | | 7/1965 | Borowsky |
| 3,196,382 | A | | 7/1965 | Morello, Jr. |
| 3,245,027 | A | | 4/1966 | Ziegler, Jr. |
| 3,275,913 | A | | 9/1966 | Blanchard et al. |
| 3,278,890 | A | | 10/1966 | Cooney |
| 3,281,757 | A | | 10/1966 | Bonhomme |
| 3,292,136 | A | | 12/1966 | Somerset |
| 3,320,575 | A | | 5/1967 | Brown et al. |
| 3,321,732 | A | | 5/1967 | Forney, Jr. |
| 3,336,563 | A | | 8/1967 | Hyslop |
| 3,348,186 | A | | 10/1967 | Rosen |
| 3,350,677 | A | | 10/1967 | Daum |
| 3,355,698 | A | | 11/1967 | Keller |
| 3,373,243 | A | | 3/1968 | Janowiak et al. |
| 3,390,374 | A | | 6/1968 | Forney, Jr. |
| 3,406,373 | A | | 10/1968 | Forney, Jr. |
| 3,430,184 | A | | 2/1969 | Acord |
| 3,448,430 | A | | 6/1969 | Kelly |
| 3,453,376 | A | | 7/1969 | Ziegler, Jr. et al. |
| 3,465,281 | A | | 9/1969 | Florer |
| 3,475,545 | A | | 10/1969 | Stark et al. |
| 3,494,400 | A | | 2/1970 | McCoy et al. |
| 3,498,647 | A | | 3/1970 | Schroder |
| 3,501,737 | A | * | 3/1970 | Harris et al. ..... 439/584 |
| 3,517,373 | A | | 6/1970 | Jamon |
| 3,526,871 | A | * | 9/1970 | Hobart ..... 439/584 |
| 3,533,051 | A | | 10/1970 | Ziegler, Jr. |
| 3,537,065 | A | | 10/1970 | Winston |
| 3,544,705 | A | | 12/1970 | Winston |
| 3,551,882 | A | | 12/1970 | O'Keefe |
| 3,564,487 | A | | 2/1971 | Upstone et al. |
| 3,587,033 | A | | 6/1971 | Brorein et al. |
| 3,601,776 | A | | 8/1971 | Curl |
| 3,629,792 | A | | 12/1971 | Dorrell |
| 3,633,150 | A | | 1/1972 | Swartz |
| 3,646,502 | A | | 2/1972 | Hutter et al. |
| 3,663,926 | A | | 5/1972 | Brandt |
| 3,665,371 | A | | 5/1972 | Cripps |
| 3,668,612 | A | | 6/1972 | Nepovim |
| 3,669,472 | A | | 6/1972 | Nadsady |
| 3,671,922 | A | | 6/1972 | Zerlin et al. |
| 3,678,445 | A | | 7/1972 | Brancaleone |
| 3,680,034 | A | | 7/1972 | Chow et al. |
| 3,681,739 | A | | 8/1972 | Kornick |
| 3,683,320 | A | | 8/1972 | Woods et al. |
| 3,686,623 | A | | 8/1972 | Nijman |
| 3,694,792 | A | | 9/1972 | Wallo |
| 3,706,958 | A | | 12/1972 | Blanchenot |
| 3,710,005 | A | | 1/1973 | French |
| 3,739,076 | A | | 6/1973 | Schwartz |
| 3,744,007 | A | | 7/1973 | Horak |
| 3,744,011 | A | | 7/1973 | Blanchenot |
| 3,778,535 | A | | 12/1973 | Forney, Jr. |
| 3,781,762 | A | | 12/1973 | Quackenbush |
| 3,781,898 | A | | 12/1973 | Holloway |
| 3,793,610 | A | | 2/1974 | Brishka |
| 3,798,589 | A | | 3/1974 | Deardurff |
| 3,808,580 | A | | 4/1974 | Johnson |
| 3,810,076 | A | | 5/1974 | Hutter |
| 3,835,443 | A | | 9/1974 | Arnold et al. |
| 3,836,700 | A | | 9/1974 | Niemeyer |
| 3,845,453 | A | | 10/1974 | Hemmer |
| 3,846,738 | A | | 11/1974 | Nepovim |
| 3,854,003 | A | | 12/1974 | Duret |
| 3,858,156 | A | | 12/1974 | Zarro |
| 3,879,102 | A | | 4/1975 | Horak |
| 3,886,301 | A | | 5/1975 | Cronin et al. |
| 3,907,399 | A | | 9/1975 | Spinner |
| 3,910,673 | A | | 10/1975 | Stokes |
| 3,915,539 | A | | 10/1975 | Collins |
| 3,936,132 | A | | 2/1976 | Hutter |
| 3,953,097 | A | | 4/1976 | Graham |
| 3,963,320 | A | | 6/1976 | Spinner |
| 3,963,321 | A | | 6/1976 | Burger et al. |
| 3,970,355 | A | | 7/1976 | Pitschi |
| 3,972,013 | A | | 7/1976 | Shapiro |
| 3,976,352 | A | | 8/1976 | Spinner |
| 3,980,805 | A | | 9/1976 | Lipari |
| 3,985,418 | A | | 10/1976 | Spinner |
| 4,017,139 | A | | 4/1977 | Nelson |
| 4,022,966 | A | | 5/1977 | Gajajiva |
| 4,030,798 | A | | 6/1977 | Paoli |
| 4,046,451 | A | | 9/1977 | Juds et al. |
| 4,053,200 | A | | 10/1977 | Pugner |
| 4,059,330 | A | | 11/1977 | Shirey |
| 4,079,343 | A | | 3/1978 | Nijman |
| 4,082,404 | A | | 4/1978 | Flatt |
| 4,090,028 | A | | 5/1978 | Vontobel |
| 4,093,335 | A | | 6/1978 | Schwartz et al. |
| 4,106,839 | A | | 8/1978 | Cooper |
| 4,125,308 | A | | 11/1978 | Schilling |
| 4,126,372 | A | | 11/1978 | Hashimoto et al. |
| 4,131,332 | A | | 12/1978 | Hogendobler et al. |
| 4,150,250 | A | | 4/1979 | Lundeberg |
| 4,153,320 | A | | 5/1979 | Townshend |
| 4,156,554 | A | | 5/1979 | Aujla |
| 4,165,911 | A | | 8/1979 | Laudig |
| 4,168,921 | A | | 9/1979 | Blanchard |
| 4,173,385 | A | | 11/1979 | Fenn et al. |
| 4,174,875 | A | | 11/1979 | Wilson et al. |
| 4,187,481 | A | | 2/1980 | Boutros |
| 4,225,162 | A | | 9/1980 | Dola |
| 4,227,765 | A | | 10/1980 | Neumann et al. |
| 4,229,714 | A | | 10/1980 | Yu |
| 4,250,348 | A | | 2/1981 | Kitagawa |
| 4,280,749 | A | | 7/1981 | Hemmer |
| 4,285,564 | A | | 8/1981 | Spinner |
| 4,290,663 | A | | 9/1981 | Fowler et al. |
| 4,296,986 | A | | 10/1981 | Herrmann et al. |
| 4,307,926 | A | | 12/1981 | Smith |
| 4,322,121 | A | | 3/1982 | Riches et al. |
| 4,326,769 | A | | 4/1982 | Dorsey et al. |
| 4,339,166 | A | | 7/1982 | Dayton |
| 4,346,958 | A | | 8/1982 | Blanchard |
| 4,354,721 | A | | 10/1982 | Luzzi |
| 4,358,174 | A | | 11/1982 | Dreyer |
| 4,373,767 | A | | 2/1983 | Cairns |
| 4,389,081 | A | | 6/1983 | Gallusser et al. |
| 4,400,050 | A | | 8/1983 | Hayward |
| 4,407,529 | A | | 10/1983 | Holman |
| 4,408,821 | A | | 10/1983 | Forney, Jr. |
| 4,408,822 | A | | 10/1983 | Nikitas |
| 4,412,717 | A | | 11/1983 | Monroe |
| 4,421,377 | A | | 12/1983 | Spinner |
| 4,426,127 | A | | 1/1984 | Kubota |
| 4,444,453 | A | | 4/1984 | Kirby et al. |
| 4,452,503 | A | | 6/1984 | Forney, Jr. |
| 4,456,323 | A | | 6/1984 | Pitcher et al. |
| 4,462,653 | A | | 7/1984 | Flederbach et al. |
| 4,464,000 | A | | 8/1984 | Werth et al. |
| 4,464,001 | A | | 8/1984 | Collins |
| 4,469,386 | A | | 9/1984 | Ackerman |
| 4,470,657 | A | | 9/1984 | Deacon |
| 4,484,792 | A | | 11/1984 | Tengler et al. |
| 4,484,796 | A | | 11/1984 | Sato et al. |
| 4,490,576 | A | | 12/1984 | Bolante et al. |
| 4,506,943 | A | | 3/1985 | Drogo |
| 4,515,427 | A | | 5/1985 | Smit |
| 4,525,017 | A | | 6/1985 | Schildkraut et al. |
| 4,531,790 | A | | 7/1985 | Selvin |
| 4,531,805 | A | | 7/1985 | Werth |
| 4,533,191 | A | | 8/1985 | Blackwood |
| 4,540,231 | A | | 9/1985 | Forney, Jr. |
| RE31,995 | E | | 10/1985 | Ball |
| 4,545,637 | A | | 10/1985 | Bosshard et al. |

4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,655,534 A 4/1987 Stursa
4,660,921 A 4/1987 Hauver
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,797,120 A 1/1989 Ulery
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,747 A 10/1991 Bawa et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda 5,474,478 A 12/1995 Ballog
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,769 A 4/2000 Kubota et al.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,676,446 B2 1/2004 Montena
6,683,253 B1 1/2004 Lee
6,692,285 B2 2/2004 Islam
6,692,286 B1 2/2004 De Cet
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,767,248 B1 7/2004 Hung
6,769,926 B1 8/2004 Montena
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,848,939 B2 2/2005 Stirling
6,848,940 B2 2/2005 Montena
6,884,113 B1 4/2005 Montena
6,884,115 B2 4/2005 Malloy
6,929,508 B1 8/2005 Holland
6,939,169 B2 9/2005 Islam et al.
6,971,912 B2 12/2005 Montena et al.
7,029,326 B2 4/2006 Montena
7,070,447 B1 7/2006 Montena
7,086,897 B2 8/2006 Montena
7,097,499 B1 8/2006 Purdy
7,102,868 B2 9/2006 Montena
7,114,990 B2 10/2006 Bence et al.
7,118,416 B2 10/2006 Montena et al.
7,125,283 B1 10/2006 Lin
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,229,303 B2 6/2007 Vermoesen et al.
7,252,546 B1 8/2007 Holland
7,255,598 B2 8/2007 Montena et al.
7,299,550 B2 11/2007 Montena
7,375,533 B2 5/2008 Gale
7,393,245 B2 7/2008 Palinkas et al.
7,404,737 B1 7/2008 Youtsey
7,452,239 B2 11/2008 Montena
7,455,550 B1 11/2008 Sykes
7,462,068 B2 12/2008 Amidon
7,476,127 B1 1/2009 Wei
7,479,035 B2 1/2009 Bence et al.
7,488,210 B1 2/2009 Burris et al.
7,494,355 B2 2/2009 Hughes et al.
7,497,729 B1 3/2009 Wei
7,507,117 B2 3/2009 Amidon
7,544,094 B1 6/2009 Paglia et al.
7,566,236 B2 7/2009 Malloy et al.
7,607,942 B1 10/2009 Van Swearingen
7,674,132 B1 3/2010 Chen
7,682,177 B2 3/2010 Berthet

| | | | |
|---|---|---|---|
| 7,727,011 | B2 | 6/2010 | Montena et al. |
| 7,753,705 | B2 | 7/2010 | Montena |
| 7,794,275 | B2 | 9/2010 | Rodrigues |
| 7,806,714 | B2 | 10/2010 | Williams et al. |
| 7,806,725 | B1 | 10/2010 | Chen |
| 7,811,133 | B2 | 10/2010 | Gray |
| 7,824,216 | B2 | 11/2010 | Purdy |
| 7,828,595 | B2 | 11/2010 | Mathews |
| 7,830,154 | B2 | 11/2010 | Gale |
| 7,833,053 | B2 | 11/2010 | Mathews |
| 7,845,976 | B2 | 12/2010 | Mathews |
| 7,845,978 | B1 | 12/2010 | Chen |
| 7,850,487 | B1 | 12/2010 | Wei |
| 7,857,661 | B1 | 12/2010 | Islam |
| 7,887,354 | B2 | 2/2011 | Holliday |
| 7,892,004 | B2 | 2/2011 | Hertzler et al. |
| 7,892,005 | B2 | 2/2011 | Haube |
| 7,892,024 | B1 | 2/2011 | Chen |
| 7,927,135 | B1 | 4/2011 | Wlos |
| 7,950,958 | B2 | 5/2011 | Mathews |
| 7,955,126 | B2 | 6/2011 | Bence et al. |
| 7,972,158 | B2 | 7/2011 | Wild et al. |
| 8,029,315 | B2 | 10/2011 | Purdy et al. |
| 8,062,044 | B2 | 11/2011 | Montena et al. |
| 8,075,338 | B1 | 12/2011 | Montena |
| 8,079,860 | B1 | 12/2011 | Zraik |
| 8,152,551 | B2 | 4/2012 | Zraik |
| 8,167,635 | B1 | 5/2012 | Mathews |
| 8,167,636 | B1 | 5/2012 | Montena |
| 8,167,646 | B1 | 5/2012 | Mathews |
| 8,172,612 | B2 | 5/2012 | Bence et al. |
| 8,192,237 | B2 | 6/2012 | Purdy et al. |
| 2002/0013088 | A1 | 1/2002 | Rodrigues et al. |
| 2002/0038720 | A1 | 4/2002 | Kai et al. |
| 2003/0214370 | A1 | 11/2003 | Allison et al. |
| 2003/0224657 | A1 | 12/2003 | Malloy |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0181652 | A1 | 8/2005 | Montena et al. |
| 2005/0181668 | A1 | 8/2005 | Montena et al. |
| 2005/0208827 | A1 | 9/2005 | Burris et al. |
| 2005/0233636 | A1 | 10/2005 | Rodrigues et al. |
| 2006/0099853 | A1 | 5/2006 | Sattele et al. |
| 2006/0110977 | A1 | 5/2006 | Matthews |
| 2006/0154519 | A1 | 7/2006 | Montena |
| 2007/0026734 | A1 | 2/2007 | Bence et al. |
| 2007/0123101 | A1 | 5/2007 | Palinkas |
| 2007/0155232 | A1 | 7/2007 | Burris et al. |
| 2007/0175027 | A1 | 8/2007 | Khemakhem et al. |
| 2007/0243759 | A1 | 10/2007 | Rodrigues et al. |
| 2008/0102696 | A1 | 5/2008 | Montena |
| 2008/0289470 | A1 | 11/2008 | Aston |
| 2009/0029590 | A1 | 1/2009 | Sykes et al. |
| 2009/0098770 | A1 | 4/2009 | Bence et al. |
| 2010/0055978 | A1 | 3/2010 | Montena |
| 2010/0081321 | A1 | 4/2010 | Malloy et al. |
| 2010/0081322 | A1 | 4/2010 | Malloy et al. |
| 2010/0105246 | A1 | 4/2010 | Burris et al. |
| 2010/0233901 | A1 | 9/2010 | Wild et al. |
| 2010/0233902 | A1 | 9/2010 | Youtsey |
| 2010/0255720 | A1 | 10/2010 | Radzik et al. |
| 2010/0255721 | A1 | 10/2010 | Purdy et al. |
| 2010/0279548 | A1 | 11/2010 | Montena et al. |
| 2010/0297871 | A1 | 11/2010 | Haube |
| 2010/0297875 | A1 | 11/2010 | Purdy |
| 2011/0021072 | A1 | 1/2011 | Purdy |
| 2011/0027039 | A1 | 2/2011 | Blair |
| 2011/0053413 | A1 | 3/2011 | Mathews |
| 2011/0117774 | A1 | 5/2011 | Malloy et al. |
| 2011/0143567 | A1 | 6/2011 | Purdy et al. |
| 2011/0230089 | A1 | 9/2011 | Amidon et al. |
| 2011/0230091 | A1 | 9/2011 | Krenceski et al. |
| 2012/0021642 | A1 | 1/2012 | Zraik |
| 2012/0094532 | A1 | 4/2012 | Montena |
| 2012/0122329 | A1 | 5/2012 | Montena |
| 2012/0145454 | A1 | 6/2012 | Montena |

FOREIGN PATENT DOCUMENTS

| | | | |
|---|---|---|---|
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| DE | 4439852 | A1 | 5/1996 |
| DE | 19957518 | A1 | 9/2001 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1548898 | | 6/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 2002075556 | A | 3/2002 |
| JP | 3280369 | B2 | 5/2002 |
| JP | 4503793 | B9 | 4/2010 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 02069457 | A1 | 9/2002 |
| WO | 2004013883 | A2 | 2/2004 |
| WO | 2006081141 | A1 | 8/2006 |
| WO | 2011128665 | A1 | 10/2011 |
| WO | 2011128666 | A1 | 10/2011 |
| WO | 2012061379 | A2 | 5/2012 |

* cited by examiner

SLIDE ACTUATED COAXIAL CABLE CONNECTOR

FIELD OF THE INVENTION

The application relates generally to the field of coaxial cable connectors and more specifically to a coaxial cable connector that more readily permits connection in relation to an external interface port.

BACKGROUND OF THE INVENTION

There are several known coaxial cable connectors presently used for CATV and related applications in which the connector is attached to a remote interface port, such as an RCA or RF port, typically found on a device such as a television, computer, or the like.

In attempting to sidestep problems associated with threaded F-type connectors being left loose, many attempts have been made to provide a push-on connector. Though the majority of these efforts provide a connector having adequate shielding and grounding, most are easily disengaged from the RF port. Some push-on connectors have provisions to either secure or latch the connector in place, but the majority of these connectors depend upon a particular port size in order to easily latch, wherein the connector maintains sufficient interference with the port to stay bound therewith. Unfortunately, ports are provided in a wide variety of finish qualities and vary significantly in the major diameter over the threaded portions thereof. There is a need to provide a latching push-on connector that can adequately latch on small ports without being too difficult to actuate on larger ports.

SUMMARY OF THE INVENTION

According to one aspect, there is provided a coaxial cable connector for coupling an end of a coaxial cable to an outer diameter of a threaded interface port. The coaxial cable connector includes a connector body, a tubular inner post, and a sleeve member. The connector body has a first end, an opposing second end, and a bore therethrough. The inner post is disposed within the bore of the connector body, and includes a first end and a second end. The first end is adapted to engage the connector body so as to prevent relative axial movement with the connector body. The second end of the inner post is adapted to be inserted into the end of the coaxial cable. Either the first end of the connector body or the first end of the inner post includes a basket portion adapted to engage the threaded interface port. The basket portion includes an outer diameter, an inner diameter that is less than the outer diameter of the threaded interface port, and a relief element. The relief element is adapted to radially expand the outer diameter of the basket portion upon engaging the interface port. The sleeve member is disposed in overlaying relation to the basket portion, and includes an inner diameter that is less than the expanded outer diameter of the basket portion. The sleeve member is axially movable in relation to the basket portion from a first position to a second position to radially compress the basket portion.

According to another version there is provided a coaxial cable connector for connecting a coaxial cable to an equipment port, said connector comprising a connector body having a first end and a second end, an inner post having a first end and a second end, said second end of said post being disposed within said connector body and wherein one of the first end of the connector body and the inner post includes a basket portion. The basket portion is defined by a cavity sized for engaging an interface port wherein the connector further includes a sleeve portion disposed in overlaying relation and slidingly movable relative to said basket portion.

An advantage realized by the present invention is that interface ports of varying size can be adaptably attached to the herein described connector.

Yet another advantage is that the herein described connector can be used for F-type connectors for CATV applications, but can be made to work with N or SMA connectors for wireless or RCA-type connectors, among others.

These and other features and advantages will become readily apparent from the following Detailed Description, which should be read in conjunction with the accompanying drawings.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

The following description relates to a number of embodiments relating to a coaxial cable connector or connector assembly that can receive varying sized interface ports without significant modification. Throughout the following description a number of terms are used in order to provide a suitable frame of reference in regard to the accompanying drawings including terms such as "distal", "proximal", "above", "below" and the like. These terms are not intended to be overlimiting of the claimed invention, except where so specifically indicated.

Figure 1:
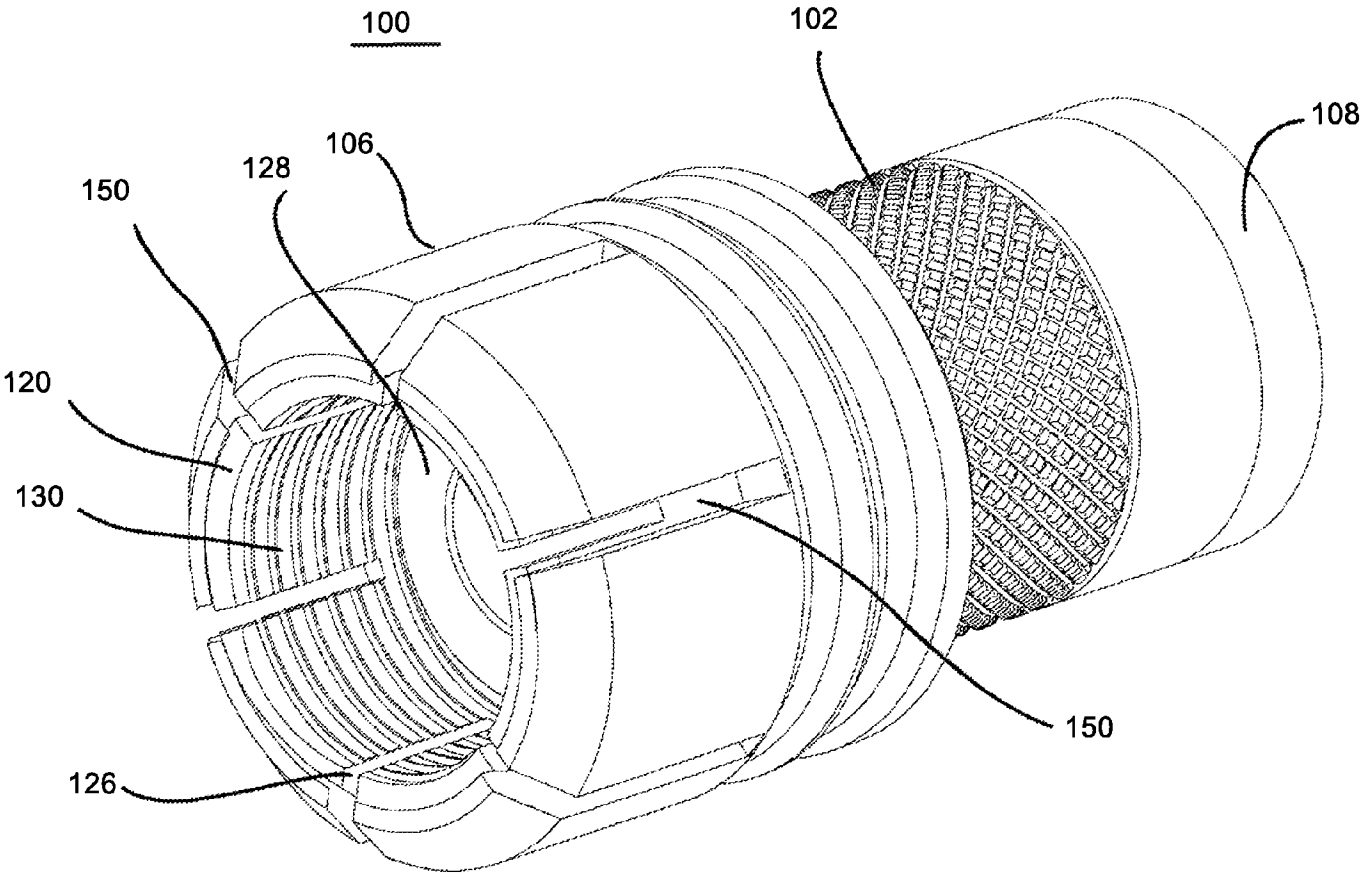
FIG. 1 is a perspective view of a coaxial cable connector in accordance with a first embodiment of the present invention.
Figure 2:
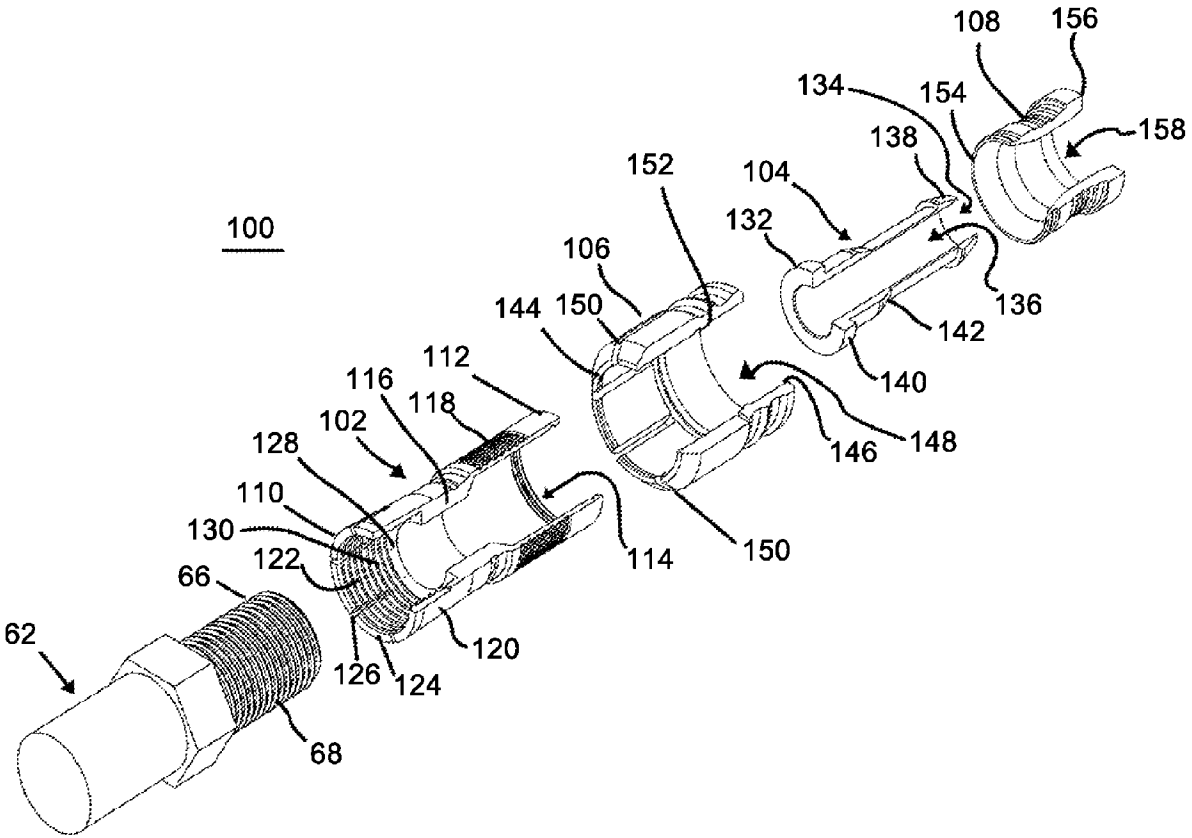
FIG. 2 is an exploded view of the coaxial cable connector of FIG. 1, partially broken away.

Referring to FIGS. 1 and 2, there is shown a coaxial cable connector or connector or connector assembly 100, which is made in accordance with a first embodiment. The connector 100 is made from an assemblage of components that includes a connector body 102, an inner post 104, a sleeve member 106 and a compression member 108.

According to this embodiment, the connector body 102 is defined by a substantially cylindrical component having first open end 110 and opposing second open end 112 as well as a center passageway 114 extending therethrough. The center passageway 114 is defined by three different inner diameters; namely, a first inner diameter at the first open end 110, a second inner diameter which is smaller than the first inner diameter through a necked portion 116, and a third inner diameter which is larger than either the first and the second inner diameters within the remainder of the connector body 102 extending to the second open end 112.

A deformable axial portion 118 is provided adjacent the second end 112 of the connector body 102, which permits radial deformation of the connector body based on corresponding axial movement of the compression member 108, as described in greater detail in a following portion of this description. As more clearly shown in FIG. 2, the first end 110 of the connector body 102 further includes a basket portion 120, the basket portion being defined by an open-ended cylindrical cavity 122 commencing at a radial face 124 at the first end 110. At least a portion of the connector body 102 and minimally, the radial face 124 of the basket portion 120 is made from an electrically conductive material, such as brass or steel, and includes a plurality of axial slots 126 formed therein, the slots being substantially equally spaced from one another circumferentially. The proximal end of the basket portion 120 is further defined by an annular shoulder 128 of the necked portion 116, the shoulder having an opening extending into the second inner diameter of the center passageway 114. In one embodiment, threads 130 are provided on the inner cylindrical surface of the radial face 124 of the defined basket portion 120, the threads having a suitable height and pitch that are sized to match those of the distal end of a remote interface port, as described in greater detail below.

The inner post 104 according to this embodiment is defined by opposing first and second ends 132, 134 with a center passageway or bore 136 extending therethrough. The inner post second end 134 is defined substantially by a shaft-like structure having a barbed end 138 that is disposed with the confines of the connector body 102 while the first end 132 includes an annular flange 140. An external surface feature 142 intermediately disposed between the first and second ends 132, 134 enables the inner post 104 to be secured relative to the connector body 102 and more specifically to the necked portion 116 thereof wherein the inner post 104 is axially as well as rotationally secured to the connector 100. When assembled, the annular flange 140 of the inner post 104 is intimately engaged with the shoulder 128 of the connector body 102, as shown for example, in FIG. 3.

Still referring to FIGS. 1 and 2, the sleeve member 106 is disposed in overlaying relation to the first end 110 of the connector body 102, the sleeve member being a substantially cylindrical section having a first beveled end 144 and an opposing second end 146 with a center passageway 148 extending therethrough. The first end 144 of the sleeve member 106 includes a plurality of axial slots 150. In this specific embodiment, six (6) slots 150 are provided, though it will be readily apparent that this number can be suitably varied. The slots 150 extend an intermediate axial distance from the first end 110 towards the second end 112 and are equally spaced circumferentially from each other. An inner annular protrusion 152 secures the sleeve member 106 to the connector body 102, preventing its removal wherein the sleeve member is axially slidable from a first position shown in FIG. 4 to a second position, shown in FIG. 8.

The compression member 108 according to this specific embodiment is defined as a substantially cylindrical section having opposing first and second ends 154, 156 and a center passageway or bore 158. The compression member 108 according to this embodiment is sized to fit within the second end 112 of the connector body 102 to secure therein a prepared coaxial cable end 60, shown partially in FIGS. 6 and 7. This specific structure depicted herein relates to that of a BNC-type connector, but it will be readily apparent that other forms of connectors, such as RCA-type and F-type connectors can also be used herein.

Figure 3:
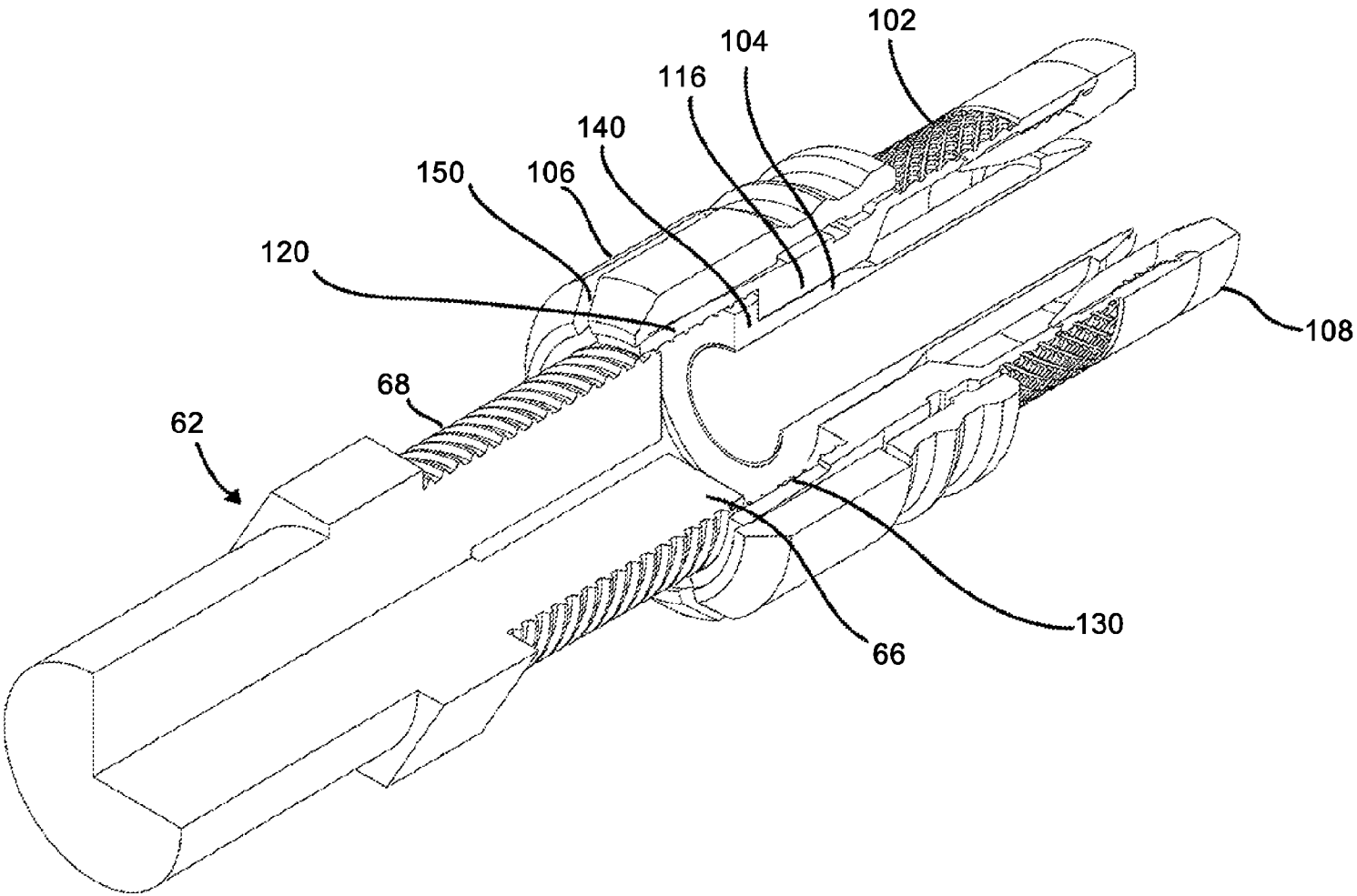
FIG. 3 is a perspective, partially broken away view of the coaxial cable connector of FIGS. 1 and 2 shown with an interface port initially attached therewith.
Figure 4:
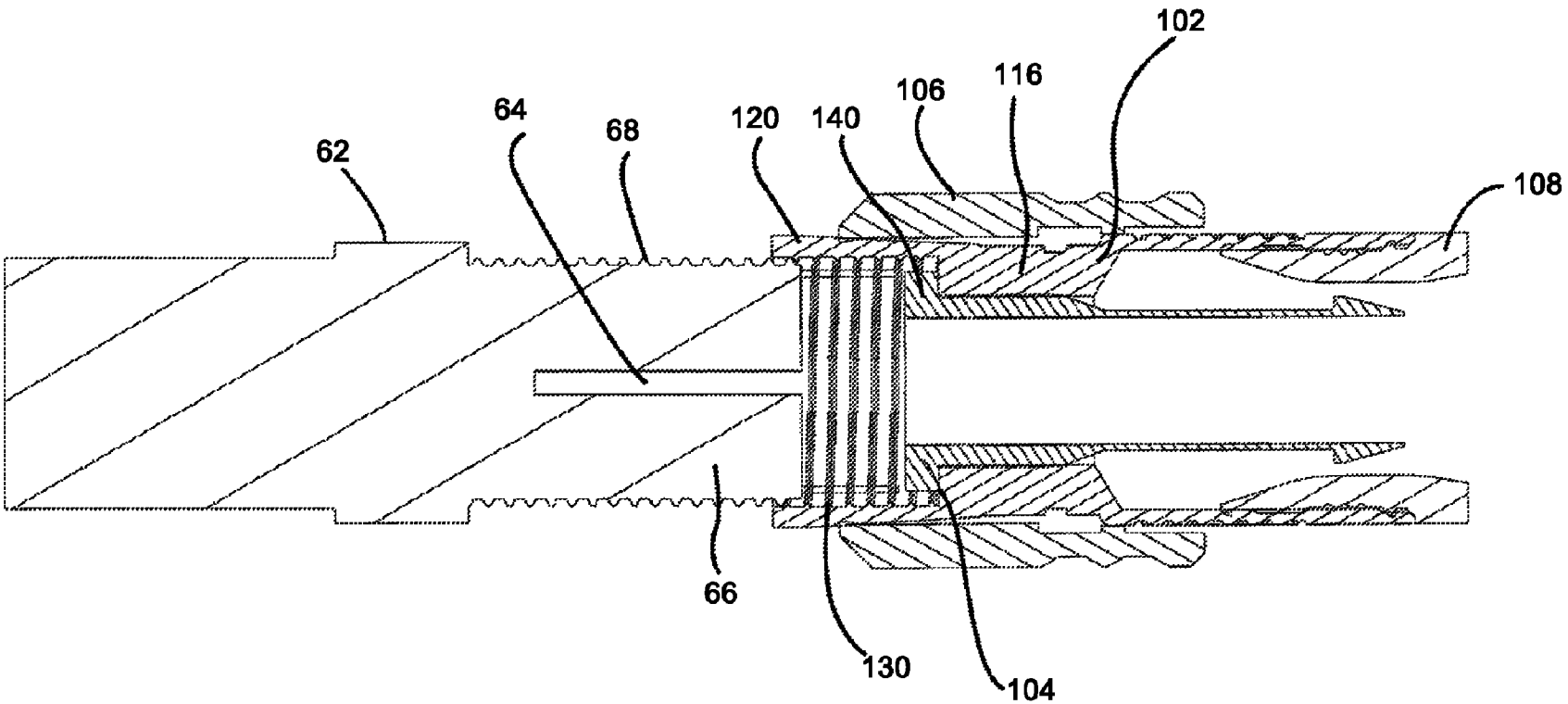
FIG. 4 is a side elevation view, in section, of the coaxial cable connector of FIG. 3, including the interface port.
Figure 5:
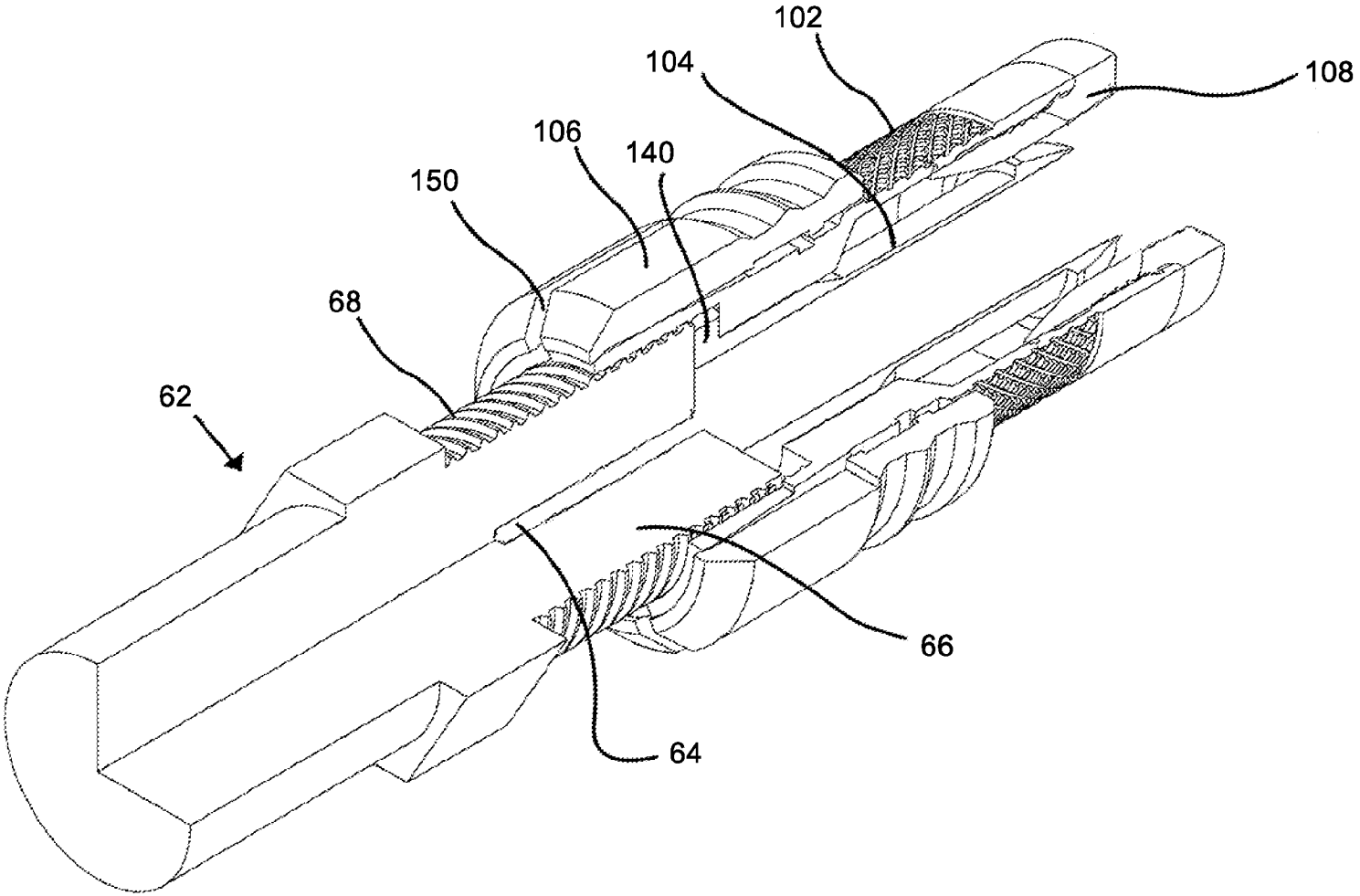
FIG. 5 is a perspective, partially broken away view of the coaxial cable connector of FIGS. 1-4, with the interface port fully attached.
Figure 6:
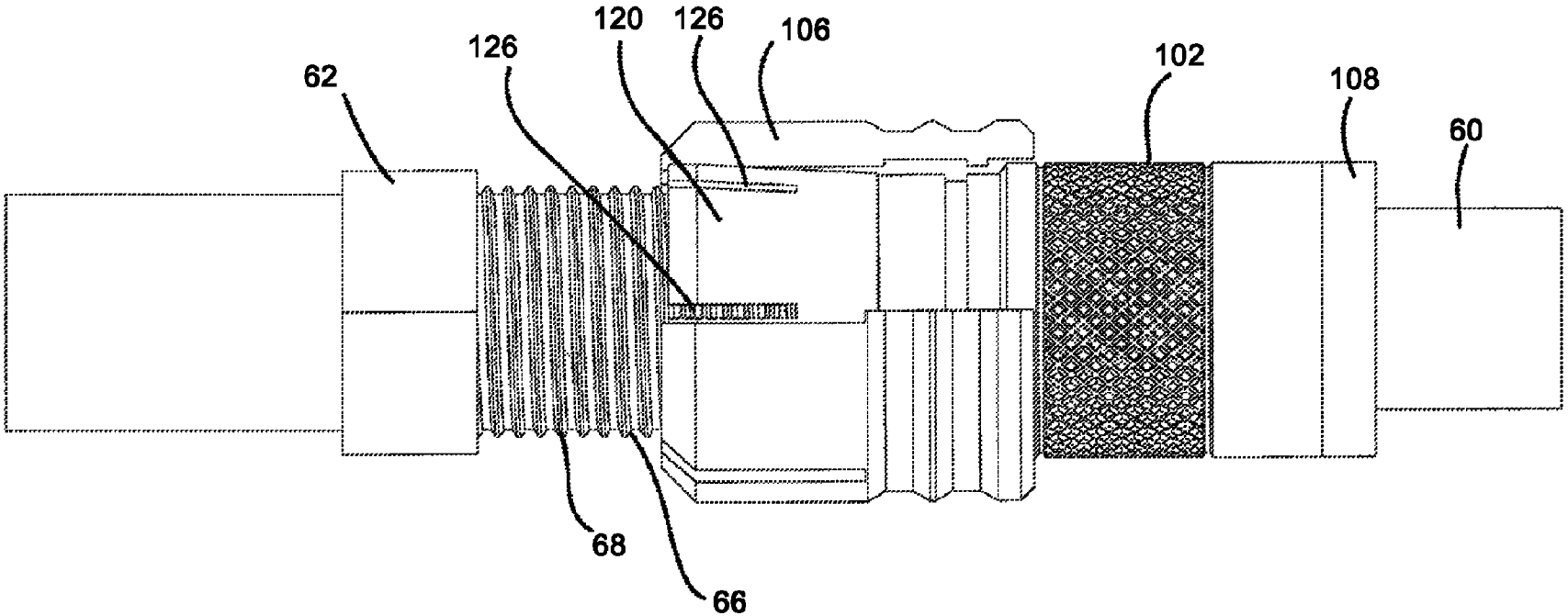
FIG. 6 is a side elevational view, partially broken away, of the coaxial cable connector of FIGS. 1-5.

Referring to FIGS. 3 and 4 and initially, an interface port 62 having a center receptacle 64 within a threaded distal end 66 is engaged with the basket portion 120 of the connector body 102. In this position, the sleeve member 106 is in a retracted axial position relative to the interface port 62. The external threads 68 of the interface port 62 are caused to engage with the internal threads 130 of the basket portion 120. As the interface port 62 engages the basket portion 120, the basket portion is caused to radially expand based on the presence of the axial slots 126, acting in a flexible manner as the interface port 62 is axially advanced toward the second end 112 of the connector body 102, as shown in FIGS. 5 and 6.

Figure 7:
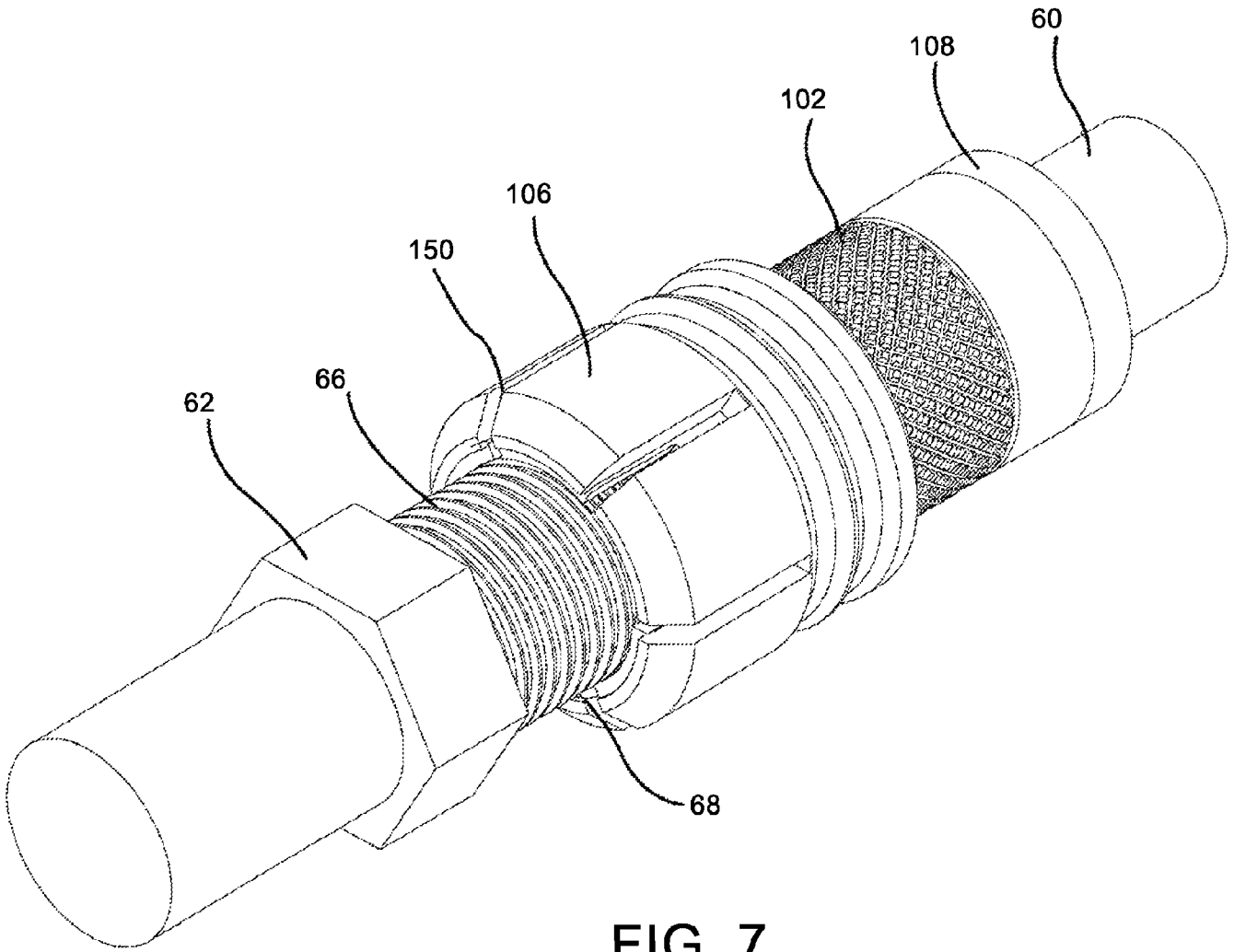
FIG. 7 is a perspective view of the coaxial cable connector of FIG. 6, without any broken away portions, in the engaged position without an attached interface port.
Figure 8:
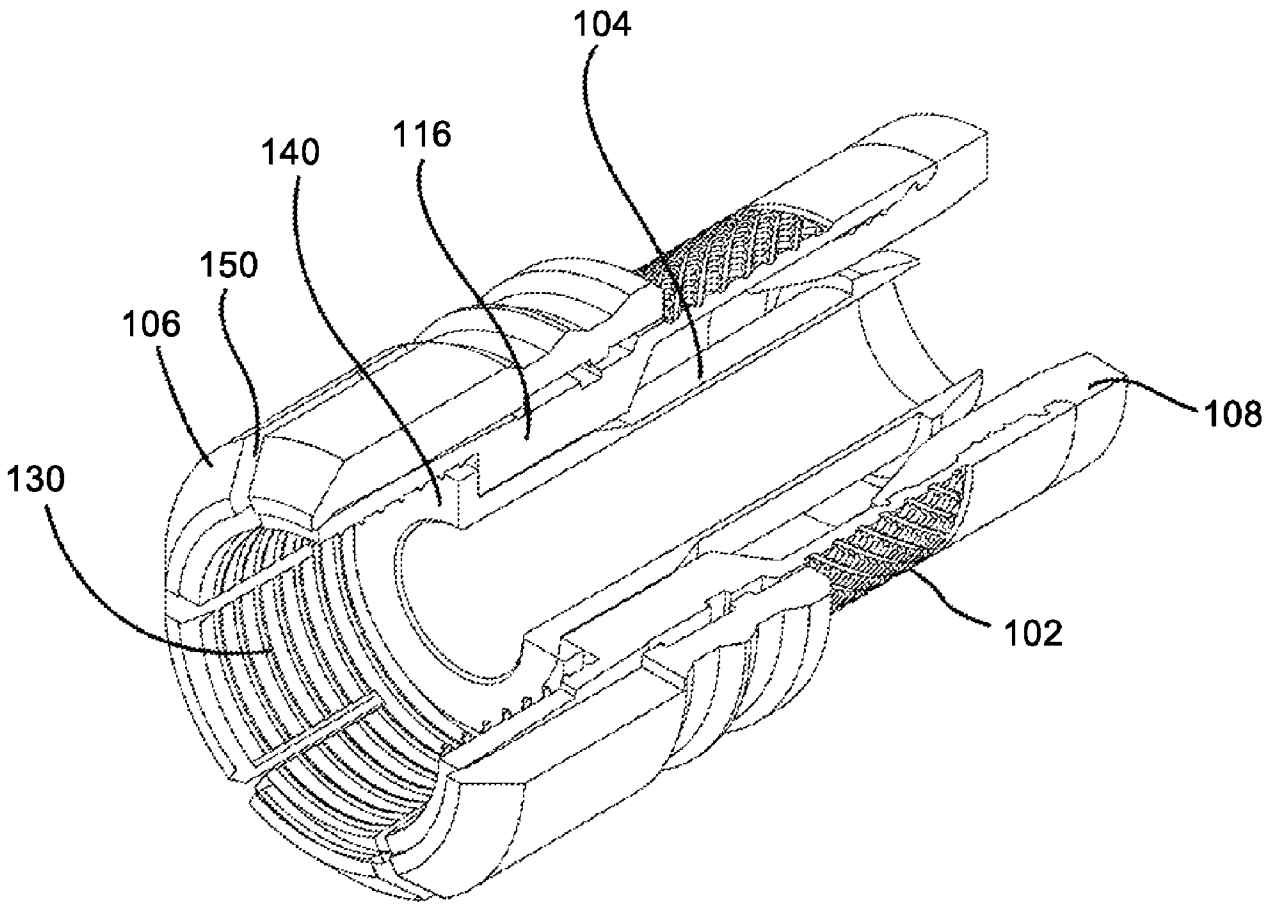
FIG. 8 is a perspective, partially broken away view of the coaxial cable connector of FIG. 7.

Once the distal end 66 of the interface port 62 is substantially within the basket portion 120, the sleeve member 106 can then be used to latch the connection by axially advancing the sleeve member toward the first end 110 of the connector body 102 to the position shown in each of FIGS. 7 and 8. This movement causes the sleeve member 106 to act in concert with the basket portion 120, thereby creating a locking collet, wherein the axial slots 150 act as spring fingers upon the basket portion 120, and producing radial compression thereupon. As a result, the interface port 62 is fully secured within the basket portion 120 of the connector 100.

Removal of the interface port 62 from the connector 100 is accomplished by reversing the previous steps. That is, the sleeve member 106 is axially translated back to its initial position, releasing the compressive forces placed upon the basket portion 120 and enabling the interface port 62 to be axially removed from the basket portion 120 by a user through relative movement.

A second embodiment of a coaxial cable connector 200 that is made in accordance with the present invention is depicted in FIGS. 9-18. Similar parts are herein labeled with the same reference numerals for the sake of clarity. The coaxial cable connector 200, like the preceding is made from an assemblage of components including a connector body 202, an inner post 204, a sleeve member 206 and a compression member 208.

According to this embodiment, the connector body 202 is defined by a substantially cylindrical portion having respective first and second ends 210, 212 and a center passageway 214 extending therethrough. The center passageway 214 is defined by two different diameters; namely, a first inner diameter at the first end 210 extending through a necked portion 216 and a second inner diameter which is larger than the first inner diameter and extending within the remainder of the connector body 202 to the second end 212.

A deformable axial portion 218 is provided adjacent the second end 212 of the connector body 202, which permits radial deformation of the connector body based upon axial movement of the compression member into the second end 212 of the connector body 202.

Figure 9:
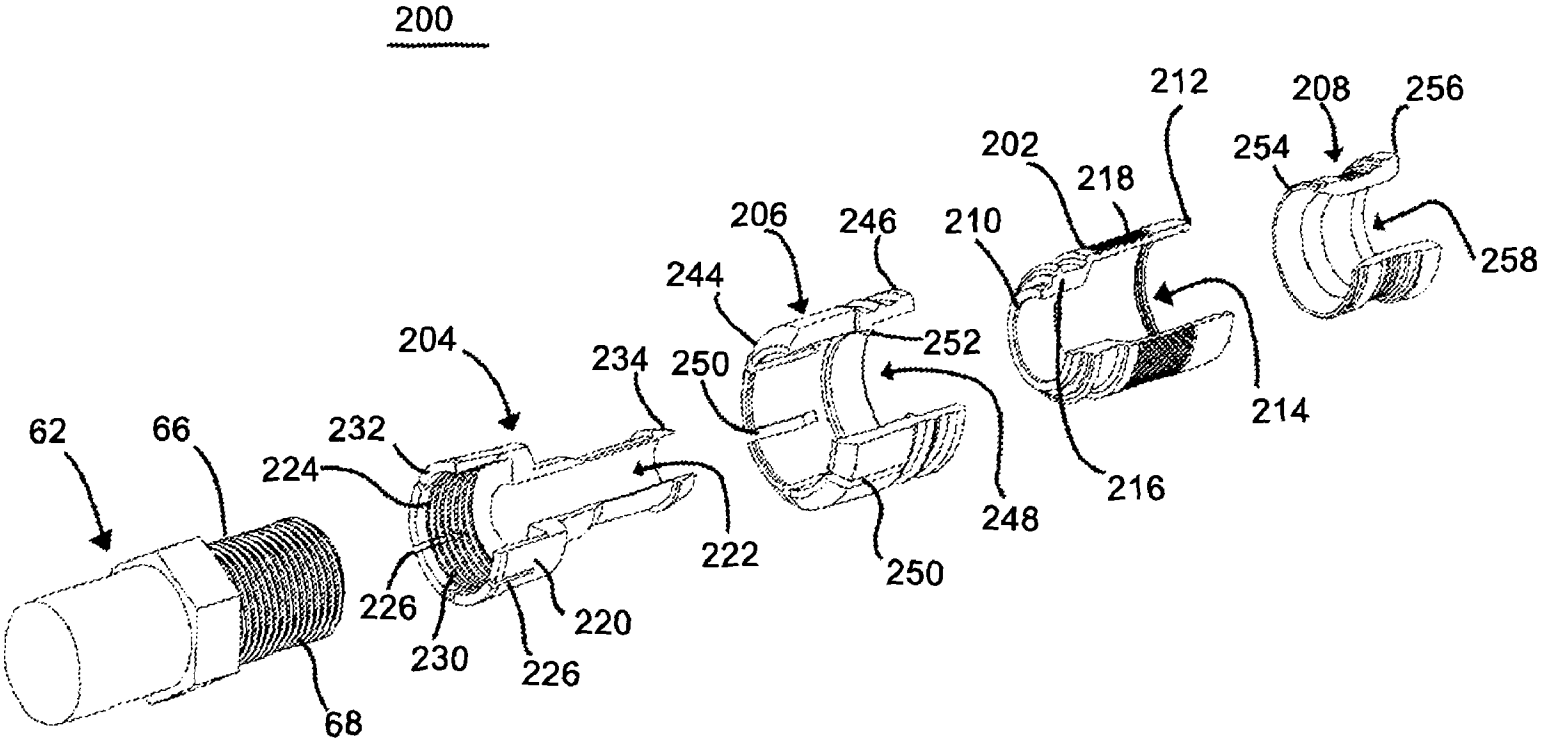
FIG. 9 is an exploded, partially broken away perspective view of a coaxial cable connector in accordance with a second embodiment of the present invention.
Figure 10:
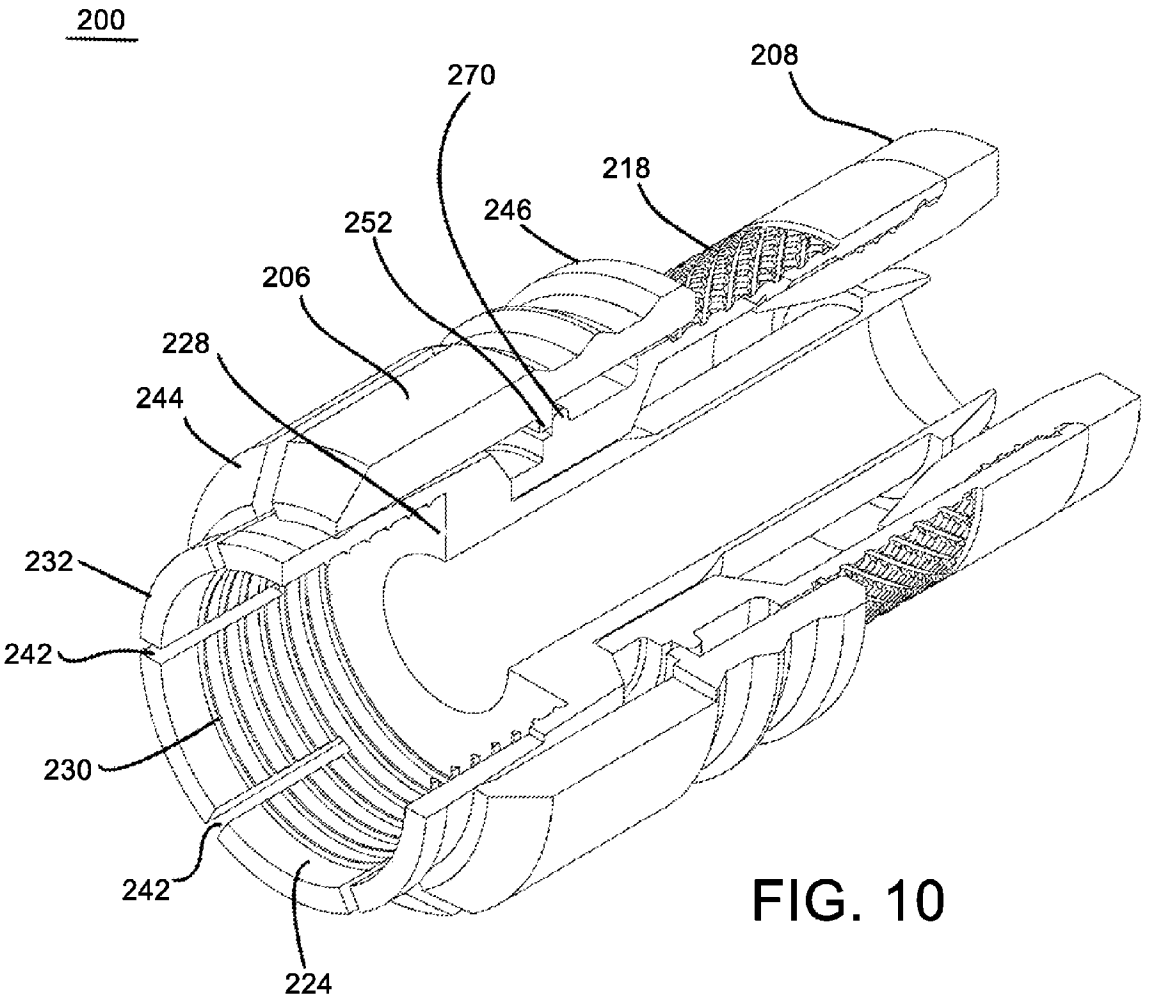
FIG. 10 is a perspective assembled view of the coaxial cable connector of FIG. 9 in a first position.
Figure 11:
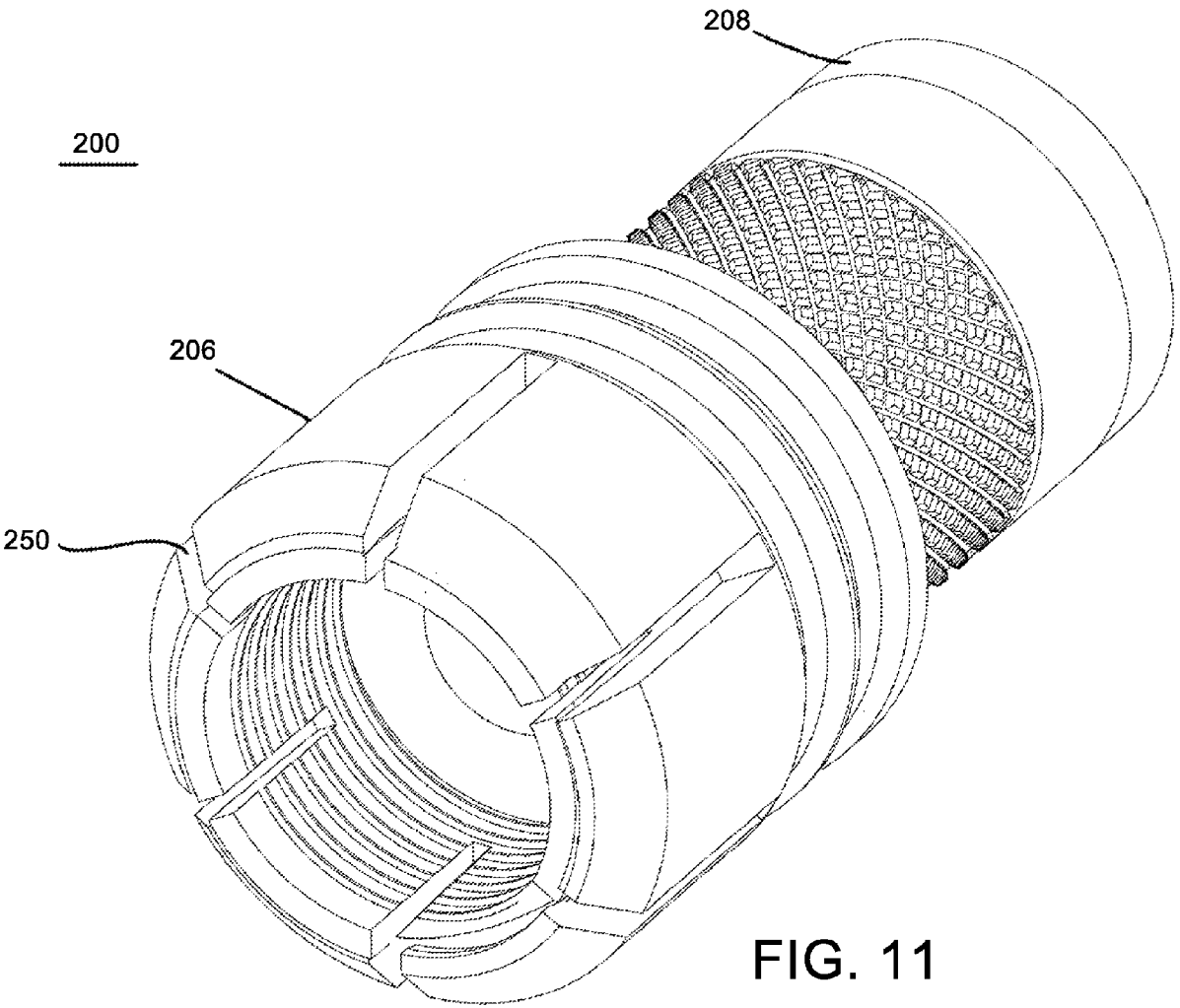
FIG. 11 is a perspective view of the coaxial cable connector of FIGS. 9 and 10 shown in a second position.

Still referring to FIGS. 9 and 10, the inner post 204 according to this embodiment is defined by opposing first and second ends 232, 234 with a center passageway or bore 236 extending therethrough. The second end 234 of the inner post 204 is defined by a shaft-like structure having a barbed end 238 that is disposed within the confines of the connector body 202. An external surface feature 242 intermediately disposed between the first and second ends 232, 234 enables the inner post 204 to be rotationally and axially secured relative to the connector body 202 and more specifically to the necked portion 216 thereof.

The first end 232 of the inner post 204 further includes a basket portion 220, the basket portion being defined by an open-ended cylindrical cavity 222 commencing at a radial face 224 of the first end. At least a portion of the inner post 204 and minimally, the radial face of the basket portion 220 is made from an electrically conductive material, such as steel or brass, and includes a plurality of axial slots 226 formed therein. The proximal end of the basket portion 220 of the inner post 204 is further defined by an annular shoulder 228 having a center opening extending therethrough to the second end 234. Internal threads 230 are provided on the inner cylindrical surface of the radial face 224 of the defined basket portion 220, the threads having a suitable height and pitch that are sized to correspond with those of a remote interface port 62, as shown, in FIG. 12. When assembled, a rear or proximal surface of the basket portion 220 is in contact with the forward or first end of the connector body 202.

Still referring mainly to FIGS. 9 and 10, the sleeve member 206 is disposed in overlaying relation to the first end 210 of the connector body 202 and inner post 204, including the basket portion 220 thereof. The sleeve member 206 is a substantially cylindrical section having a first beveled end 244 and an opposing second end 246 with a center passageway 248 extending therethrough. According to this embodiment, the sleeve member 206 is made from a metal, such as brass, wherein the first end 244 further includes a plurality of axial slots 250 extending from the first end 244 to an intermediate axial length. According to this specific embodiment, six (6) axial slots 250 are provided, although it will be readily apparent that this parameter can be suitably varied. The axial slots 250 are equally spaced from one another circumferentially. Alternatively and though not shown, the sleeve member could be formed from a durable plastic, such as polyamide, which has been thinned considerably to provide a similar effect. According to this embodiment, an inner annular protrusion 252 secures the sleeve member 206 in relation to an external ring portion or outer annular protrusion 270 of the first end of the connector body 202, as shown in FIG. 10.

The compression member 208 according to this embodiment is defined as a substantially cylindrical section having opposing first and second ends 254, 256 and a center passageway or bore 258 that extends entirely therethrough. The compression member 208 is sized to fit within the second end 212 of the connector body 202 to secure therein a prepared coaxial cable end 60, partially shown in FIGS. 12 and 16. Like the preceding, this specific structure relates to that of a BNC-type coaxial cable connector, but it will be readily apparent that other types of connectors, such as F-type and RCA-type connectors, can also be used herein.

Figure 12:
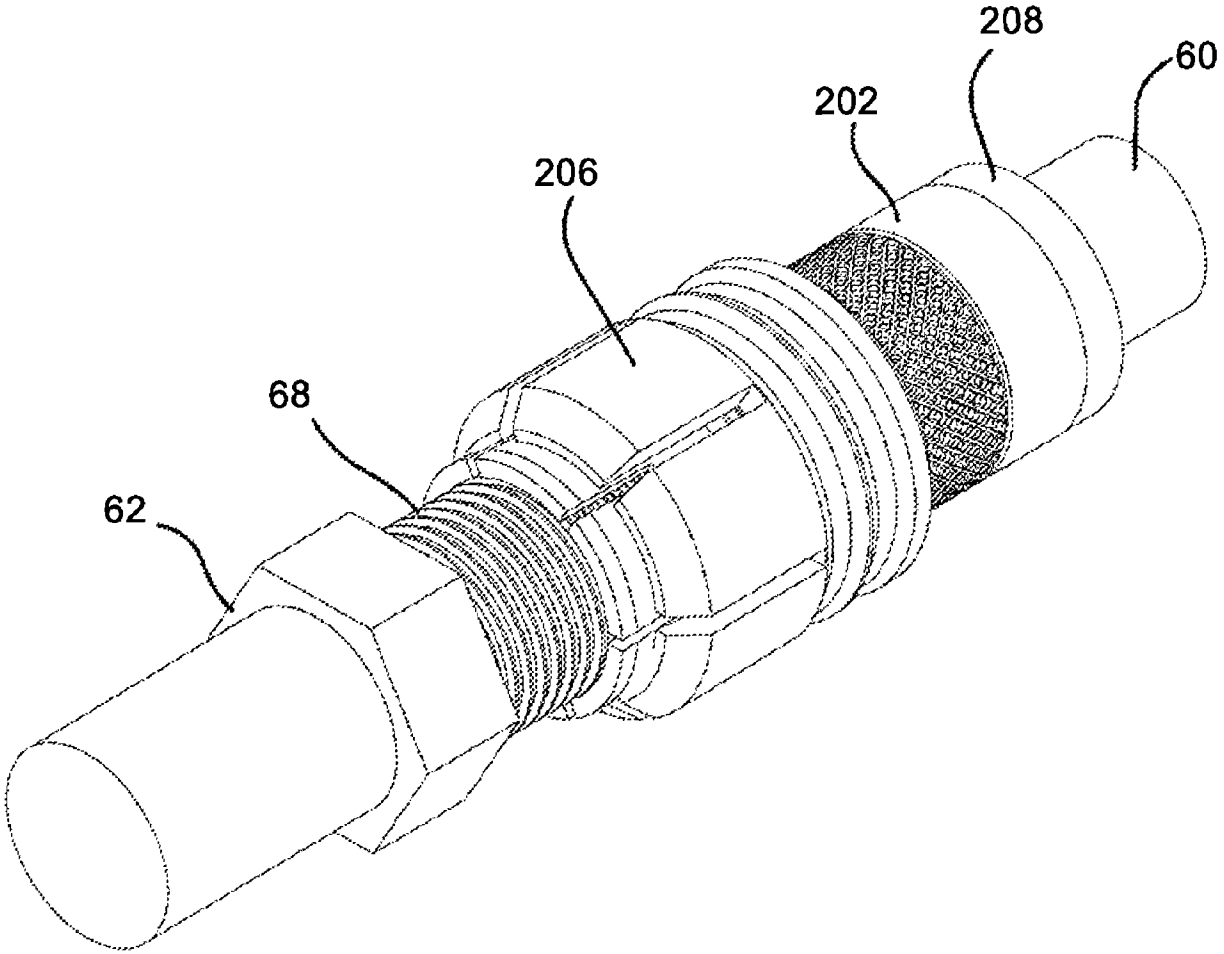
FIG. 12 is a perspective assembled view of the coaxial cable connector of FIGS. 9-11, in the first position in relation to an attached interface port.
Figure 13:
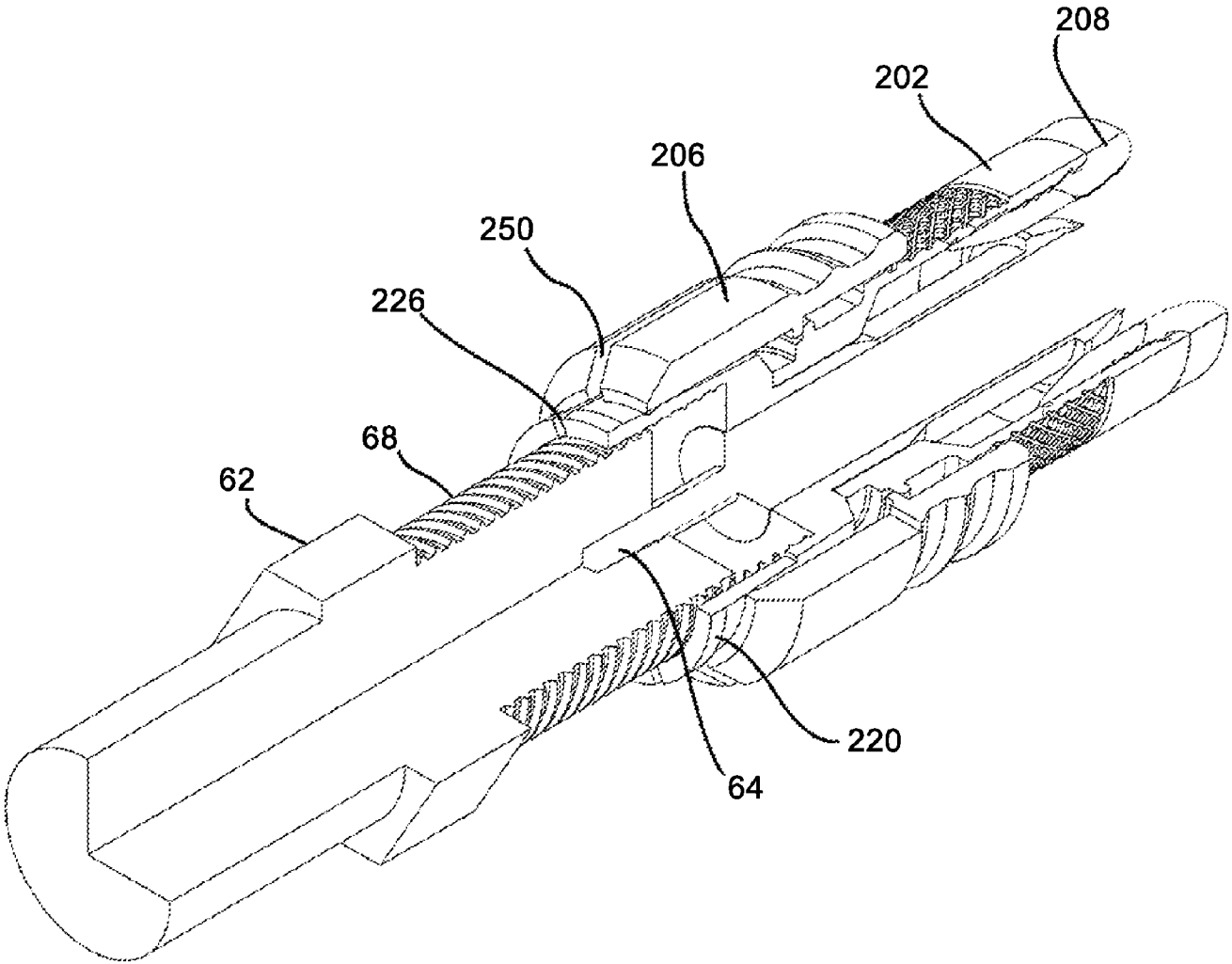
FIG. 13 is a perspective broken away view of the coaxial cable connector of FIGS. 9-12, depicting the operation of the connector in the first position.
Figure 14:
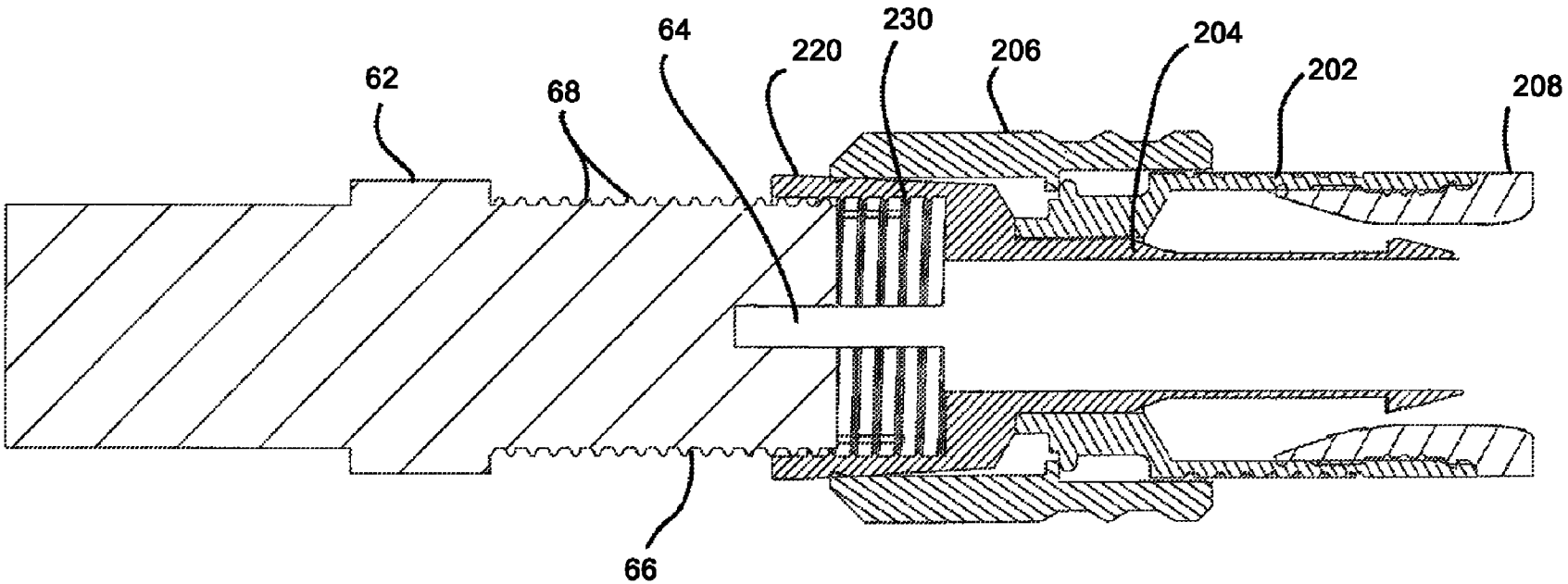
FIG. 14 is a side elevational view, taken in section, of the coaxial cable connector of FIGS. 9-13, depicting the interface port in the first position.

Referring to FIGS. 12 and 13 and initially, a remote interface port 62 having a center receptacle 64 within a threaded distal end 66 is engaged with the basket portion 220 of the connector 200. As shown, the sleeve member 206 is in a retracted or first axial position relative to the remainder of the connector 200 wherein a portion of the basket portion 220 extends distally outward from the sleeve member. The external threads 68 of the interface port are caused to engage with the internal threads 230 of the basket portion 220 of the inner post 204. As the interface port 62 engages the basket portion 220, the spring fingers of the basket portion 220 are caused to expand radially outwardly as the interface port is axially advanced toward the second end 234 of the inner post 204.

Figure 15:
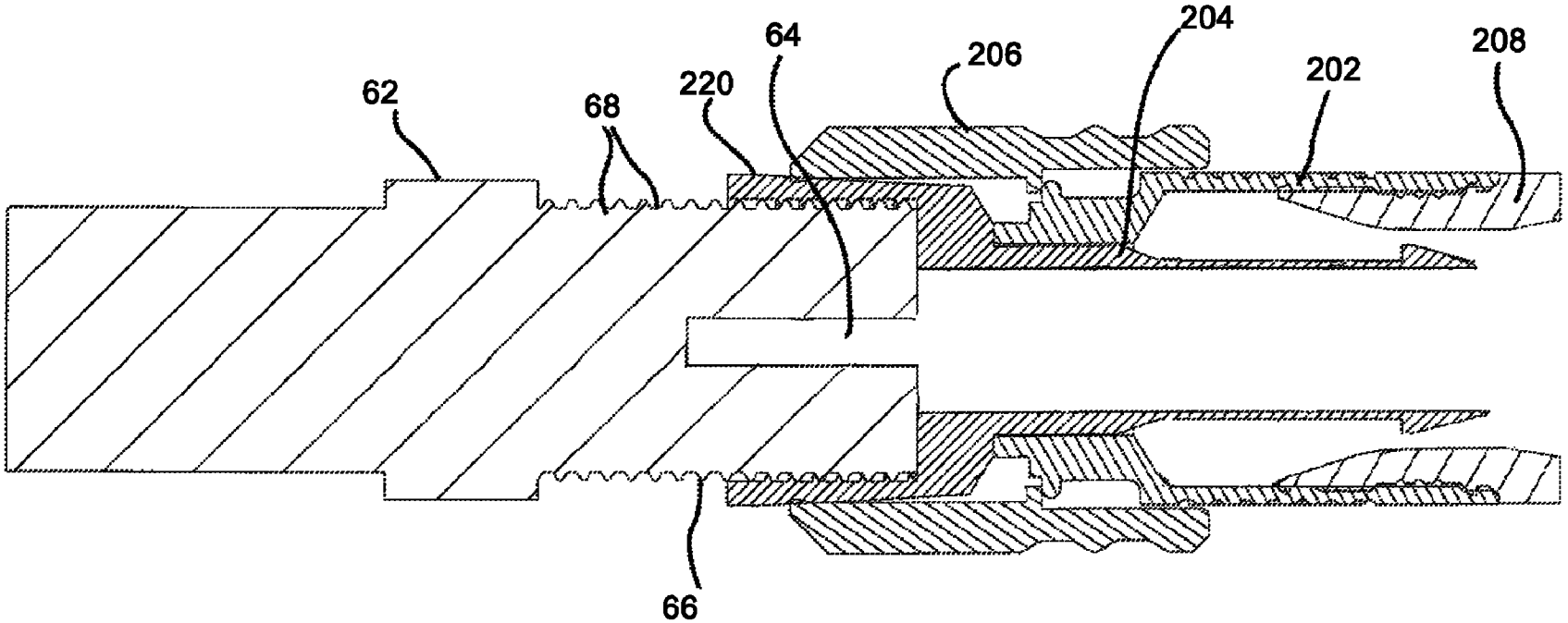
FIG. 15 is a side elevational view, taken in section, of the coaxial cable connector of FIGS. 9-13 depicting the interface port in a fully engaged position prior to closure of the sleeve member.
Figure 16:
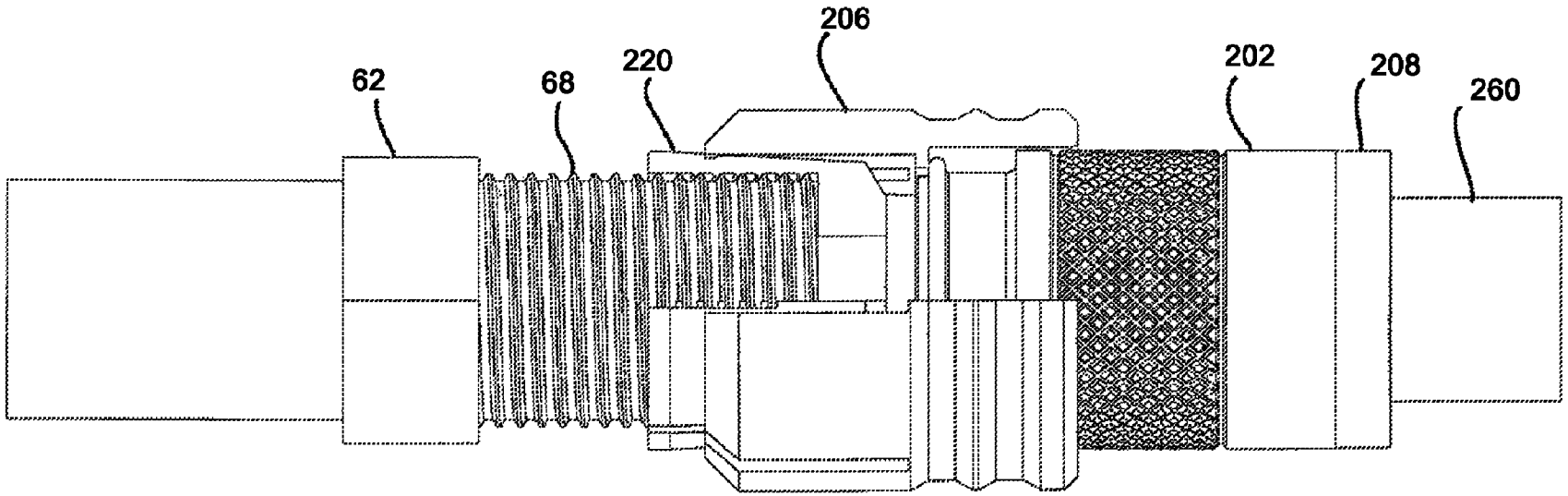
FIG. 16 is another side elevational view, partially broken away, of the coaxial cable connector of FIGS. 9-15 with the interface port in the fully engaged position and prior to closure of the sleeve member.
Figure 17:
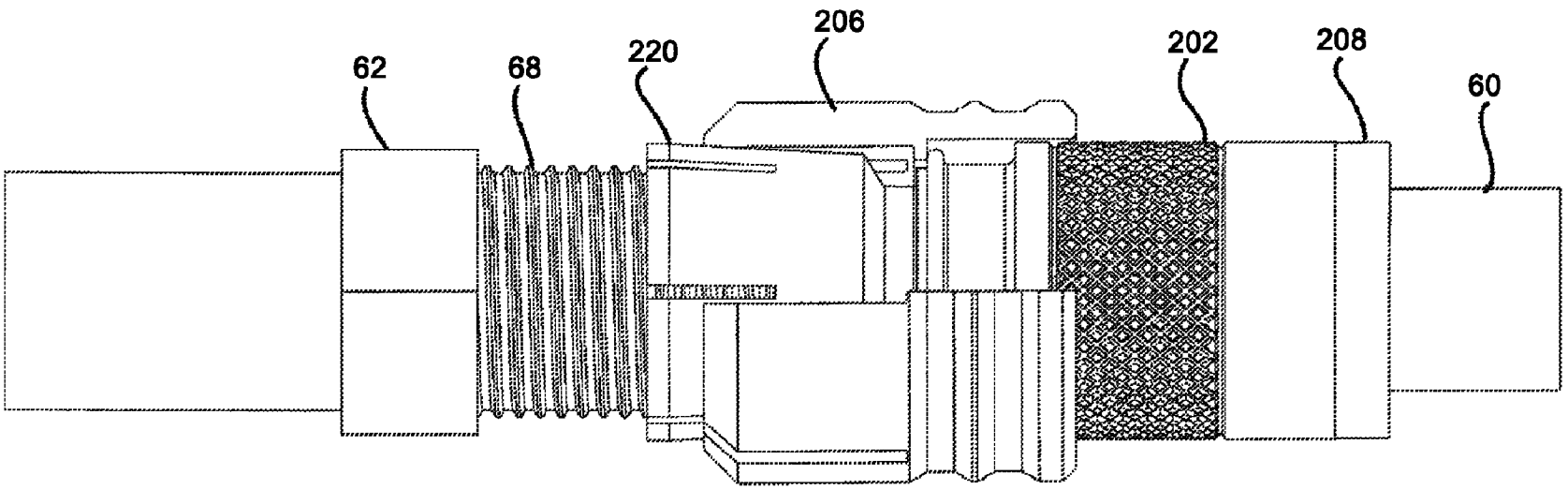
FIG. 17 is yet another side elevational view, also partially broken away, of the coaxial cable connector of FIG. 9-16 with the interface port in the fully engaged position prior to closure of the sleeve member.
Figure 18:
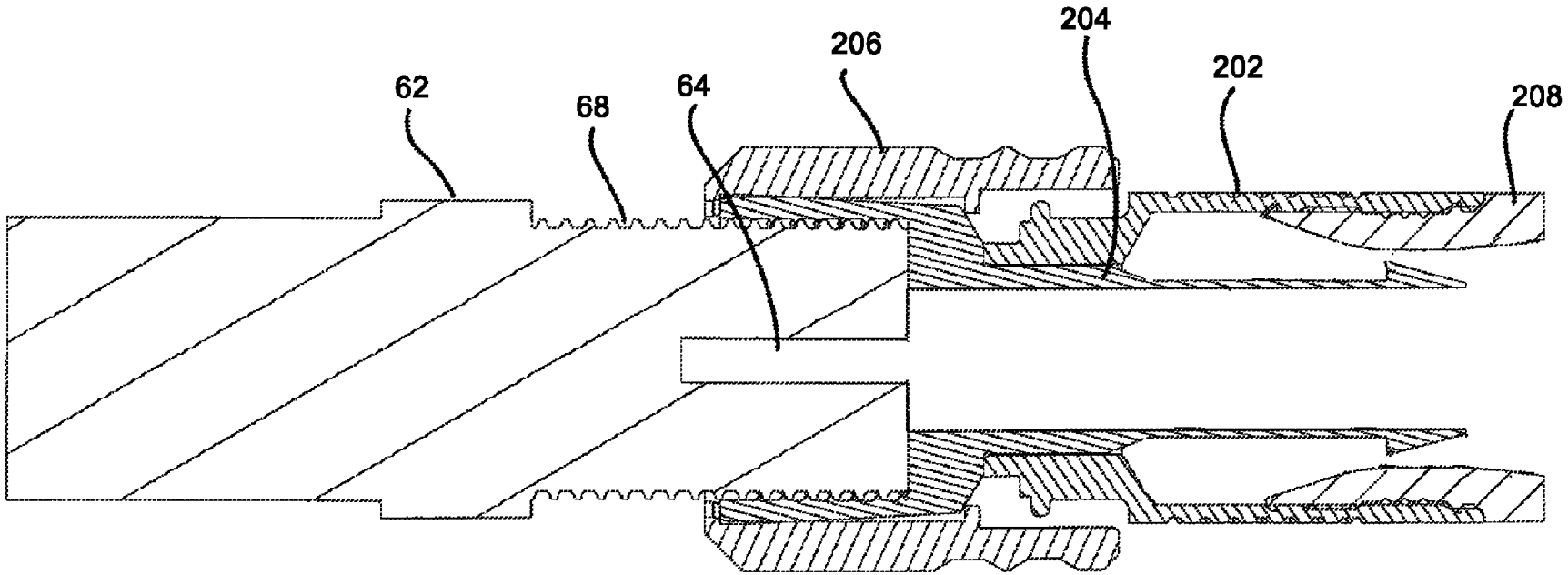
FIG. 18 is a side elevational view, taken in section, of the coaxial cable connector of FIGS. 9-17 with the interface port fully engaged and the sleeve member closed.

Once the interface port 62 is fully engaged within the basket portion 220, as shown in FIGS. 15-17, the sleeve member 206 can then be used to latch the connection by axially advancing the sleeve member 206 toward the first end 232 5 of the inner post 204, to the position shown in FIG. 18. This axial movement of the sleeve member 206 causes the sleeve member in concert with the basket portion 220 of the inner post 204 to act as a locking collet, wherein the axial slots 250 act as spring fingers upon the basket portion 220, producing radial compression thereon. As a result, the interface port 62 is fully secured within the basket portion 220 of the connector 200.

As in the preceding, removal of the remote interface port 62 is accomplished by reversing each of the preceding steps. That is, the sleeve member 206 is axially translated back to its initial position, shown in FIG. 10, releasing the radial compressive forces placed upon basket portion 220 and enabling the interface port 62 to be axially removed from the basket portion 220 by a user, through relative movement thereof wherein movement of the sleeve member 206 is restricted beyond the initial axial position by the engagement of the inner protrusion of the sleeve member with the outer ring projection 270 of the connector body 202.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

What is claimed is:

1. A coaxial cable connector for coupling an end of a coaxial cable to an outer diameter of a threaded interface port, the connector comprising:

a connector body having a first end, an opposing second end, and a bore therethrough;

a tubular inner post disposed within the bore of the connector body, the inner post having a first end and a second end, the first end adapted to engage the connector body so as to prevent relative axial movement with the connector body, the second end of the inner post adapted to be inserted into the end of the coaxial cable;

wherein one of the first end of the connector body and the first end of the inner post includes a basket portion adapted to engage the threaded interface port, the basket portion comprising an outer diameter, an inner diameter that is less than the outer diameter of the threaded interface port, and a relief element adapted to radially expand the outer diameter of the basket portion upon engaging the interface port; and a sleeve member disposed in overlaying relation to the basket portion, the sleeve member comprising an inner diameter that is less than the expanded outer diameter of the basket portion, the sleeve member being axially slidably movable in relation to the basket portion from a first position to a second position to radially compress the basket portion onto the threaded interface port, wherein the sleeve member includes a plurality of axial slots.

2. The coaxial cable connector of claim 1, wherein the relief element of the basket portion comprises a plurality of axial slots, permitting radial compression thereof.

3. The coaxial cable connector of claim 1, wherein the relief element of the basket portion comprises a material having elastic properties.

4. The coaxial cable connector of claim 1, wherein the sleeve member is made from plastic.

5. The coaxial cable connector of claim 1, wherein the sleeve member is made from metal.

6. The coaxial cable connector of claim 1, wherein the basket portion includes a set of internal threads.

7. The coaxial cable connector of claim 1, wherein the basket portion is made from an electrically conductive material.

8. The coaxial cable connector of claim 1, further comprising an axial locking element to impede the sleeve member from moving from the second position back to the first position.

9. The coaxial cable connector of claim 8, wherein the axial locking element comprises an annular protrusion on the inner diameter of the sleeve member and an outer annular protrusion on the connector body.

10. In combination, a coaxial cable connector for coupling an end of a coaxial cable to an outer diameter of a threaded port, the coaxial cable connector comprising:

a connector body having a first end, an opposing second end, and a bore therethrough;

an inner post having a first end and a second end, the second end of the post being disposed within the connector body and wherein the first end of one of the connector body and the inner post includes a basket portion and wherein the basket portion is defined by a cavity sized for engaging an interface port; and a sleeve portion disposed in overlaying relation to the basket portion, the sleeve portion being axially slidably movable in relation to the basket portion from a first position to a second position to radially compress the basket portion onto the threaded interface port, wherein the sleeve portion includes a plurality of axial slots.

11. The combination as recited in claim 10, wherein the basket portion includes a cylindrical radial face having a plurality of axial slots defined therein.

12. The combination as recited in claim 10, wherein the sleeve member is made from plastic.

13. The combination as recited in claim 10, wherein the sleeve member is made from metal.

14. The combination as recited in claim 10, wherein the basket portion is made from an electrically conductive material.

15. The combination as recited in claim 10, wherein the basket portion includes a set of internal threads for engaging external threads of the interface port.

16. The combination as recited in claim 10, wherein the basket portion is formed in the first end of the inner post.

17. The combination as recited in claim 10, wherein the basket portion is formed in the first end of the connector body.

18. The combination as recited in claim 10, further including a compression member attached to the second end of the connector body for securing a prepared coaxial cable end.

* * * * *